United States Patent [19]

Davis et al.

[11] 4,097,619

[45] Jun. 27, 1978

[54] MANIFOLD CARBONLESS FORM AND PROCESS FOR THE CONTINUOUS PRODUCTION THEREOF

[75] Inventors: Gerald Titus Davis; Dale Richard Shackle, both of Chillicothe, Ohio

[73] Assignee: The Mead Corporation, Dayton, Ohio

[21] Appl. No.: 684,460

[22] Filed: May 7, 1976

[51] Int. Cl.[2] ..... B05D 3/06

[52] U.S. Cl. ..... 427/44; 282/27.5; 427/54; 427/150; 427/151; 427/152; 427/401

[58] Field of Search ..... 427/401, 152, 54, 150, 427/151, 44; 282/27.5; 428/306, 307, 342, 323, 327, 537

[56] References Cited

U.S. PATENT DOCUMENTS

| | | | |
|---|---|---|---|
| 2,170,140 | 8/1939 | Grupe | 427/152 |
| 2,781,278 | 2/1957 | Harmon | 427/152 |
| 3,759,807 | 9/1973 | Osborn et al. | 427/44 |
| 3,955,025 | 5/1976 | Matsukawa | 427/152 |
| 3,957,495 | 5/1976 | Teranishi et al. | 427/150 |
| 3,979,270 | 9/1976 | Trecker et al. | 427/54 |
| 3,981,523 | 9/1976 | Maalouf | 427/152 |
| 3,996,405 | 12/1976 | Porter | 427/150 |
| 4,012,554 | 5/1977 | Miller et al. | 427/150 |

*Primary Examiner*—Ronald H. Smith

*Assistant Examiner*—Janyce A. Bell

*Attorney, Agent, or Firm*—Charles N. Shane, Jr.; Stephen H. Cagle; Wilson G. Palmer

[57] ABSTRACT

This invention relates to a process for the continuous production of a manifold carbonless form having one or more surfaces coated with capsular chromogenic material. The process comprises providing a plurality of continuous webs and advancing each continuous web of the plurality of continuous webs at substantially the same speed, the plurality of continuous webs being spaced apart and being advanced in a cooperating relationship with one another. At least one web of the plurality of continuous webs is marked with a pattern and at least one non-aqueous, solvent-free coating of the capsular, chromogenic material is applied to at least a portion of at least one continuous web of the plurality of continuous webs. The non-aqueous, solvent-free coating is then set followed by collating of the plurality of continuous webs. The collated, continuous webs are placed in contiguous relationship to one another to create a manifold form. After the continuous webs are placed in collated, contiguous relationship they can be finished by any combination of the steps of combining, partitioning, stacking, packaging and the like. This invention also relates to the manifold form which is the product of the process of this invention.

17 Claims, 6 Drawing Figures

MANIFOLD CARBONLESS FORM AND PROCESS FOR THE CONTINUOUS PRODUCTION THEREOF

BACKGROUND OF THE INVENTION

1. Field of the Invention

This invention relates to pressure sensitive copying systems, and more particularly to a process for the continuous production of a manifold carbonless form and to the carbonless form itself.

2. Prior Art

Manifold forms for commercial and private use have been in common use for several years. Historically, the standard business form has taken a variety of shapes. The most common is a multiple part form with sheets of carbon paper being insertable between the various sheets. This concept is very cumbersome as the carbon paper had to be both inserted, removed and disposed of in addition to the deficiencies commonly noted in the use of carbon paper such as smudging. In response to the obvious problems a form was developed having the carbon paper already inserted between the various sheets making up the form and being available for easy removal and disposal. This removal and disposal was made even more convenient by the attachment of the carbon paper together at one edge, generally the bottom, so that by merely ripping out the bottommost edge of the form all of the carbon paper would be removed. This system has been and still is being used by many retail department stores. All of these systems have historically suffered from one common deficiency, namely the use of carbon paper. Carbon paper, while adequate for some image transfer purposes is not a preferred product as it is very cumbersome to work with, it is very messy and in general does not form the quality image which is desired. In addition, as is commonly encountered with the use of carbon paper the more sheets of carbon paper that are used the fainter the image on the last sheets of the form. This is especially true where more than three to four sheets per form are used. Examples of patents relating generally to the use and manufacture of carbon paper and other image transfer systems containing dyes and pigments are:

U.S. Pat. No. 2,299,694 (1942) to Green
U.S. Pat. No. 3,374,862 (1945) to Green
U.S. Pat. No. 3,016,308 (1962) to Macauley
U.S. Pat. No. 3,020,170 (1962) to Macauley
U.S. Pat. No. 3,079,351 (1963) to Staneslow et al In recognition of the deficiencies of carbon paper as an image transfer media a variety of new products have been introduced into the marketplace. One such product is commonly referred to as carbonless paper. Carbonless paper, briefly stated, is a standard type of paper wherein during manufacture the backside of the paper substrate is coated with what is referred to as a CB coating, the CB coating containing one or more color precursors generally in capsular form. At the same time the front side of the paper substrate is coated during manufacture with what is referred to as a CF coating, which contains one or more color developers. Both the color precursor and the color developer remain in the coating compositions on the respective back and front surfaces of the paper in colorless form. This is true until the CB and CF coatings are brought into abutting relationship and sufficient pressure, as by a typewriter, is applied to rupture the CB coating to release the color precursor. At this time the color precursor contacts the CF coating and reacts with the color developer therein to form an image. Thus the image from the top sheet or transfer sheet is transferred to the next sheet or image sheet without the use of carbon paper. Carbonless paper has proved to be an exceptionally valuable image transfer media for a variety of reasons only one of which is the fact that until a CB coating is placed next to a CF coating both the CB and the CF are in an inactive state as the co-reactive elements are not in contact with one another. Patents relating to carbonless paper products are:

U.S. Pat. No. 2,712,507 (1955) to Green
U.S. Pat. No. 2,730,456 (1956) to Green et al A third generation product which is in an advanced stage of development and commercialization at this time and which is available in some business sectors is referred to as self-contained paper. Very generally stated self-contained paper refers to an image transfer system wherein only one side of the paper needs to be coated and the one coating contains both the color precursor, generally in encapsulated form, and the color developer. Thus when pressure is applied, again as by a typewriter or other writing instrument, the color precursor capsule is ruptured and reacts with the surrounding color developer to form an image. Both the carbonless paper image transfer system and the self-contained transfer system have been the subject of a great deal of patent activity. A typical autogeneous record material system, sometimes referred to as "self-contained" because all elements for making a mark are in a single sheet, is disclosed in U.S. Pat. No. 2,730,457 (1956) to Green.

A disadvantage of coated paper products such as carbonless and self-contained stems from the necessity of applying a liquid coating composition containing the color forming ingredients during the manufacturing process. In the application of such coatings volatile solvents are sometimes used which then in turn require evaporation of excess solvent to dry the coating thus producing volatile solvent vapors. An alternate method of coating involves the application of the color forming ingredients in an aqueous slurry, again requiring removal of excess water by drying. Both methods suffer from serious disadvantages. In particular the solvent coating method necessarily involves the production of generally volatile solvent vapors creating both a health and a fire hazard in the surrounding environment. In addition, when using an aqueous solvent system the water must be evaporated which involves the expenditure of significant amounts of energy. Further, the necessity of a drying step requires the use of complex and expensive apparatus to continuously dry a substrate which has been coated with an aqueous coating compound. A separate but related problem involves the disposal of polluted water. The application of heat not only is expensive, making the total paper manufacturing operation less cost effective, but also is potentially damaging to the color forming ingredients which are generally coated onto the paper substrate during manufacture. High degrees of temperature in the drying step require specific formulation of wall-forming compounds which permit the use of excess heat. The problems encountered in the actual coating step are generally attributable to the necessity for a heated drying step following the coating operation.

As can be appreciated from the above the continuous production of a manifold paper product would require simultaneous coating, simultaneous drying, simultaneous printing, and simultaneous collating and finishing of a plurality of paper substrates. Because of the complexities of the drying step this has not been commercially possible to date. More particularly, the drying step involving solvent evaporation and/or water evaporation and the input of heat does not permit the simultaneous or continuous manufacture of manifold forms. In addition to the drying step which prevents continuous manifold form production the necessity for the application of heat for solvent evaporation is a serious disadvantage since aqueous and other liquid coatings require that special grades of generally more expensive paper be employed and even these often result in buckling, distortion or warping of the paper since water and other liquids tend to strike through or penetrate the paper substrate. Additionally, aqueous coatings and some solvent coatings are generally not suitable for spot application or application to limited areas of one side of a sheet of paper. They are generally suitable only for application to the entire surface area of a sheet to produce a continuous coating. Patents considered relevant to this concept are:

Canadian Pat. No. 945,443 (1974) to Busch.

U.S. Pat. No. 3,914,511 (1975) to Vassiliades

Another problem which has been commonly encountered in attempts to continuously manufacture manifold forms has been the fact that a paper manufacturer must design paper from a strength and durability standpoint to be adequate for use in a large variety of printing and finishing machines. This requires a paper manufacturer to evaluate the coating apparatus of the forms manufacturers he supplies in order that the paper can be designed to accommodate the apparatus and process designed exhibiting the most demanding conditions. Because of this, a higher long wood fiber to short wood fiber ratio must be used by the paper manufacturer than is necessary for most coating, printing or finishing machines in order to achieve a proper high level of strength in his finished paper product. This makes the final sheet product more expensive as the long fiber is generally more expensive than a short fiber. In essence, the separation of paper manufacturer from forms manufacturer, which is now common, requires that the paper manufacturer overdesign his final product for a variety of machines, instead of specifically designing the paper product for known machine conditions.

By combining the manufacturing, printing and finishing operations into a single on-line system a number of advantages are achieved. First, the paper can be made using ground wood and a lower long fiber to short fiber ratio as was developed supra. This is a cost and potentially a quality improvement in the final paper product. A second advantage which can be derived from a combination of manufacturing, printing and finishing is that waste or re-cycled paper hereinafter sometimes referred to as "broke" can be used in the manufacture of the paper since the quality of the paper is not of an overdesigned high standard. Third and most importantly, several steps in the normal process of the manufacture of forms can be completely eliminated. Specifically drying steps can be eliminated by using a non-aqueous, solvent-free coating system and in addition the warehousing and shipping steps can be avoided thus resulting in a more cost efficient product.

Additionally, by using appropriate coating methods, namely non-aqueous, solvent-free coating compositions and methods, and by combining the necessary manufacturing and printing steps, spot printing and spot coating can be realized. Both of these represent a significant cost savings but nevertheless one which is not generally available when aqueous or solvent coatings are used or where the manufacture, printing and finishing of paper are performed as separate functions. An additional advantage of the use of solvent-free, non-aqueous coating compositions and the combination of paper manufacturer, printer and finisher is that when the option of printing followed by coating is available significant cost advantages occur. More particularly, by printing prior to coating from about 10% to about 30% fewer capsulated color forming ingredients need to be used to achieve the same satisfactory levels of image transferability. This advantage is realized because when the paper is transferred to a forms manufacturer in coated form the paper of necessity will lose some of its capsulated color formers when printed because of the pressure rupturability of the material. This disadvantage is eliminated when the paper is printed first followed by coating.

Many of the particular advantages of the process and product of this invention are derived from the fact that a non-aqueous, solvent-free coating composition is used to coat the paper substrate. This is in contrast to the coatings used by the prior art which have generally required an aqueous or solvent coating. For purposes of this application the term "100% solids coating" will sometimes be used to describe the coating operation and should be understood to refer to the fact that a non-aqueous, solvent-free coating composition is used and therefore the normal drying step normally present in the manufacture of paper and in coating has been eliminated.

SUMMARY OF THE INVENTION

This invention relates to a process for the continuous production of a manifold carbonless form having one or more surfaces coated with capsular chromogenic material. The process comprises providing a plurality of continuous webs and advancing each continuous web of the plurality of continuous webs at substantially the same speed, the plurality of continuous webs being spaced apart and being advanced in a cooperating relationship with one another. At least one web of the plurality of continuous webs is marked with a pattern and at least one non-aqueous, solvent-free coating of the capsular, chromogenic material is applied to at least a portion of at least one continuous web of the plurality of continuous webs. The non-aqueous, solvent-free coating is then set followed by collating of the plurality of continuous webs. The collated, continuous webs are placed in contiguous relationship to one another to create a manifold form. After the continuous webs are placed in collated, contiguous relationship they can be finished by any combination of the steps of combining, partitioning, stacking, packaging and the like. This invention also relates to the manifold form which is the product of the process of this invention.

DETAILED DESCRIPTION OF THE PREFERRED EMBODIMENT

Figure 1:
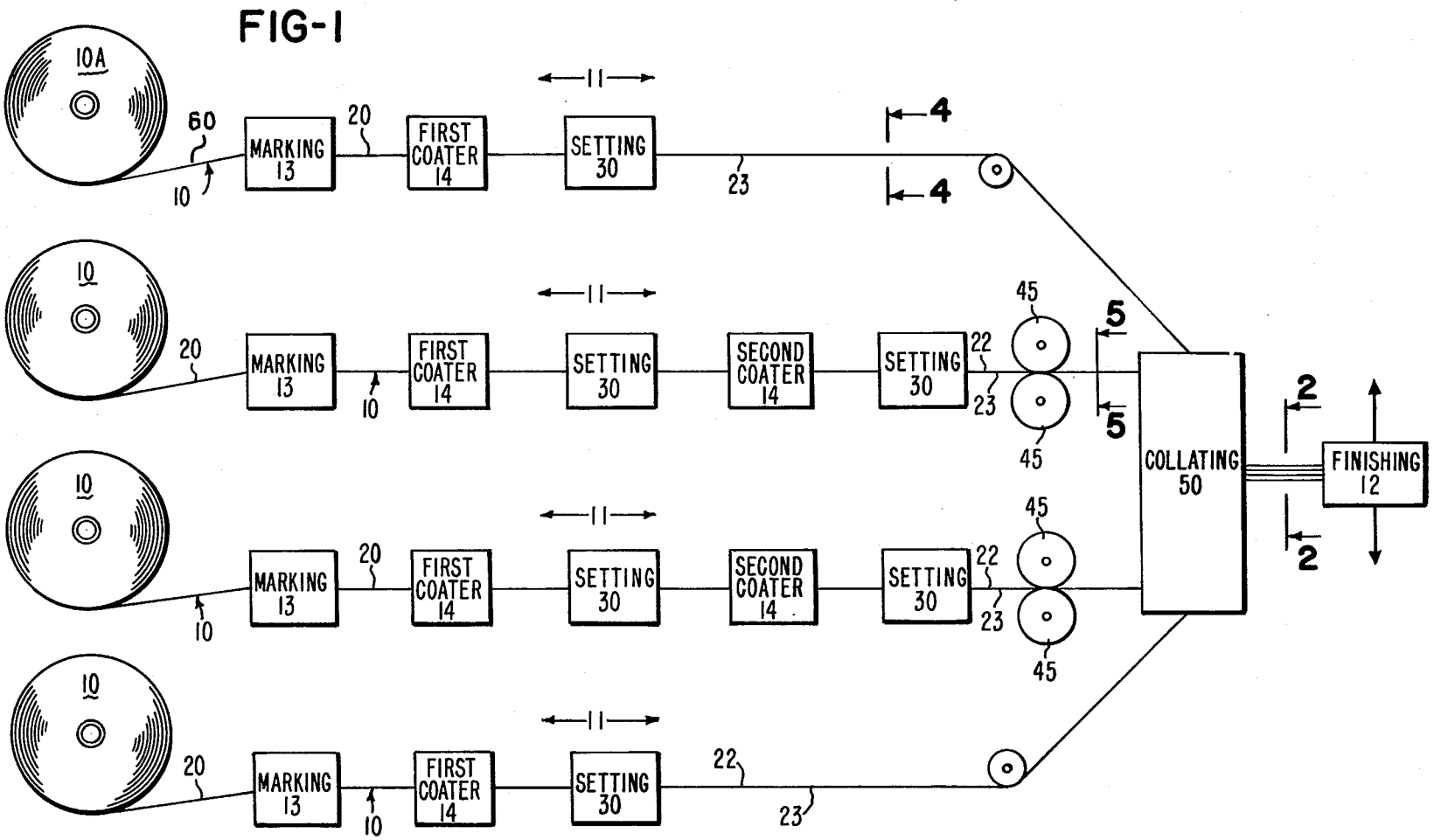
FIG. 1 is a flow chart schematically illustrating the manufacture of a four part carbonless form according to the preferred process of this invention.
Figure 2:
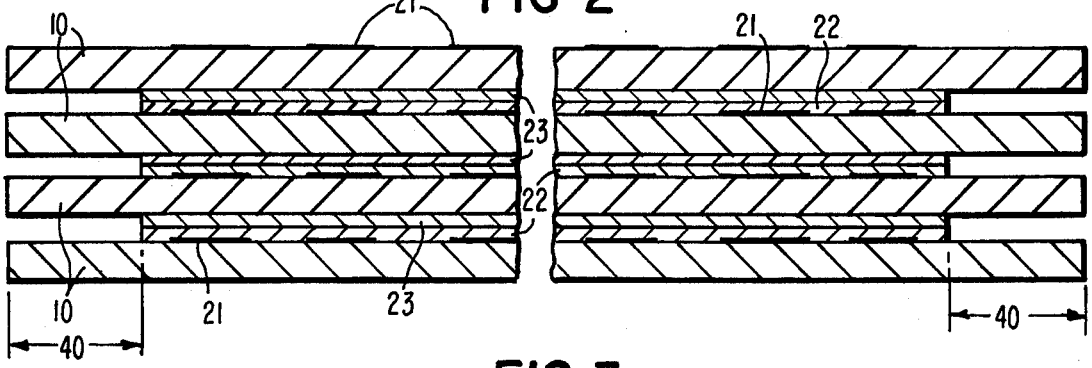
FIG. 2 is a cross-sectional view of the four part carbonless form of FIG. 1 taken along line 2—2 of FIG. 1 and viewed in the direction of the arrows.
Figure 3:
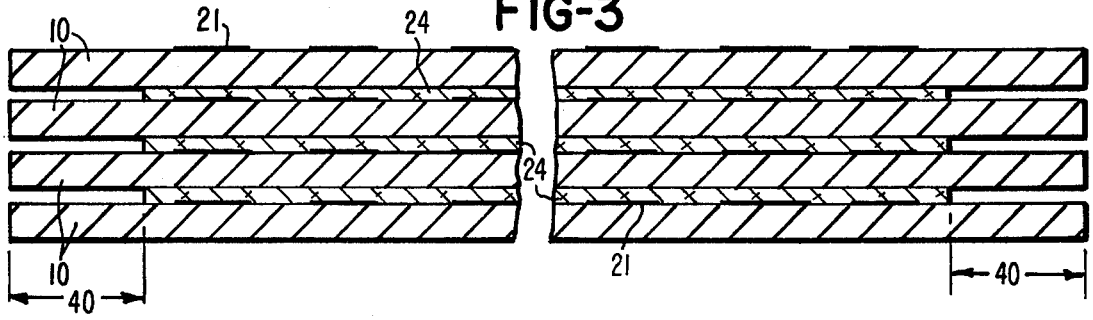
FIG. 3 is a cross-sectional view of a four part self-contained form taken along a line which would correspond to line 2—2 of FIG. 1 if self-contained coating materials were used instead of carbonless coating material.
Figure 4:
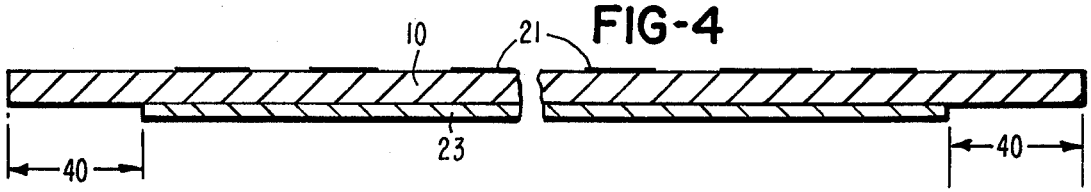
FIG. 4 is a cross-sectional view of a single web of FIG. 1 taken along line 4—4 of FIG. 1 and viewed in the direction of the arrows.
Figure 5:
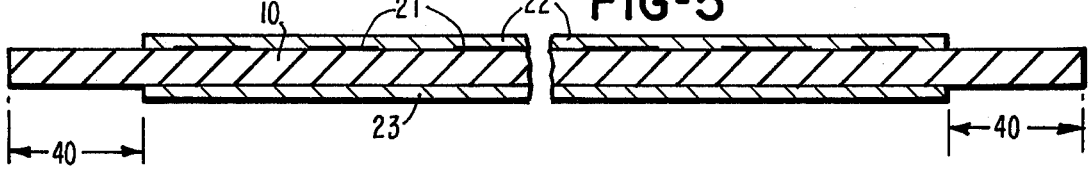
FIG. 5 is a second cross-sectional view of a single web of FIG. 1 taken along line 5—5 of FIG. 1 and viewed in the direction of the arrows.
Figure 6:
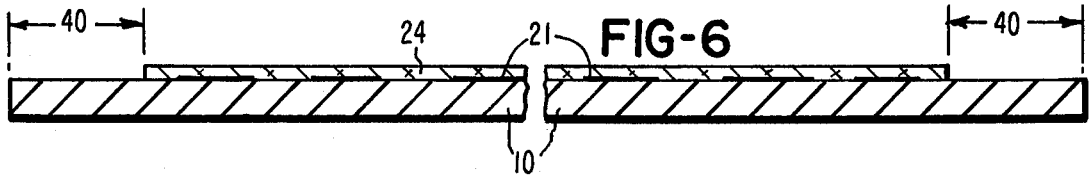
FIG. 6 is a cross-sectional view of a single web coated with a self-contained coating composition taken along a line which would correspond to line 5—5 of FIG. 1 if self-contained coating materials were used instead of carbonless coating material.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated embodiment and such further applications of the principles of the invention as illustrated therein, being contemplated as would normally occur to one skilled in the art to which the invention relates.

The process of this invention is directed to the continuous production of manifold carbonless forms. For purposes of this application the term "continuous production" shall be understood to refer to the simultaneous, cooperative production of manifold forms. The term "carbonless" as used herein shall be understood to be a generic term to encompass any type of image transfer paper or paper system not requiring the use of carbon paper. The carbonless paper will be described herein as having a topmost and bottommost surface corresponding to those surfaces as they would appear to a person using the paper. One, both or none of the surfaces of the carbonless paper can be coated with chromogenic material in the form of capsules, microcapsules, droplets or other vehicle dispersed in a binder. Preferably the chromogenic material is microencapsulated. Included in the chromogenic materials are color precursors, color developers, color inhibitors, like materials and combinations thereof.

The manifold carbonless forms of this invention will usually comprise from about 2 to about 10 individual sheets and preferably from about 2 to about 4 individual sheets per form. The actual number of sheets or layers making up the particular carbonless form is not limiting to the practice of the process of this invention, but rather can be manufactured to the convenience of the individual customer.

The continuous webs 10, sometimes referred to herein as substrates, are any of those commonly used in the manufacture of carbonless papers. Included in the preferred continuous web 10 materials are paper and plastic although other substrates can be substituted. The continuous webs 10 can be supplied in any of a variety of shapes, sizes and configurations. The preferred and most common shape is in a roll form as is illustrated in FIG. 1. While the particular dimensions of the roll are not critical a standard roll would be sized at approximately a width of from about 3 inches to about 72 inches and a total length of approximately from about 500 feet to about 10,000 yards. This range of sizes has been found suitable to fit most printing and coating apparatus.

In an alternative, but less preferred, embodiment the continuous web 10 can be supplied as an on-line substrate forming process. In this particular embodiment the manifold carbonless form manufacturing process is the final stage in the paper making process. While this is an acceptable alternate method it presents a variety of problems specific to manufacturing operations such as shut-down time which would require the simultaneous shutting down of several paper forming lines and also the problem of physical manufacturing space.

The preferred continuous web 10 material is paper and as developed supra the overall quality of the paper can be somewhat lower than was previously considered acceptable and as a result the paper can generally be made using some ground woods and additionally the paper has a lower long fiber to short fiber ratio. This cost saving advantage of lower overall paper quality is realized because the paper can be manufactured specifically for use in combination with known coating and printing apparatus.

While the apparatus which can be used in the process of this invention includes apparatus which is traditionally used in paper manufacturing and forms printing it is important to note the necessity that several lines 11 be operating simultaneously in a cooperating relationship. By this it is meant that as the various continuous webs 10 are advanced towards their final finishing or packing station 12 they must be advanced at substantially the same speed and other process variables must be specifically controlled. If the individual paper webs 10 are various colors indicating second or third copies the processing must be coordinated so that the colors of the forms are properly arranged. Additionally, it is preferred although not essential that the size of the individual continuous webs 10 be substantially equal. It is necessary in the manufacture of carbonless paper forms that the CB/CF coatings be adjacent to one another; and finally it is necessary that the distinction be made between carbonless and self-contained so that two sides coated with a self-contained coating composition are not adjacent to each other. For purposes of this application the arranging of the various sheets in the proper order shall be sometimes referred to as collating the sheets, webs or substrates.

A particular advantage enjoyed by the process of this invention is the fact that the printing or marking step illustrated by the number 13 can be completed prior to the coating step illustrated by the number 14. In this fashion it can be seen that fewer encapsulated materials need be coated on the paper as from about 10% to about 30% of the encapsulated material which is normally ruptured or otherwise destroyed during the printing operation 13 is not necessary as the web 10 has already been printed during the coating 14 operation. It can be appreciated also that the individual continuous webs 10 must be maintained in a spaced relationship during processing to permit the various coating 14 and printing 13 stations to operate continuously. This is in contrast to what was previously possible due to the fact that formerly after any coating step a drying step was of necessity required, the drying step generally requiring the application of substantial heat and the expendiutre of a significant amount of energy. If a heated drying step were necessary in the coating or other processing of this invention the use of this process would not be economically feasible. This represents a substantial cost and convenience advantage over any methods shown or disclosed by the prior art.

As described above in the preferred process of this invention the individual substrates 10 are subjected to a printing or marking step 13 prior to the coating step 14. While this is preferred it is not critical. For purposes of this application the term "marking" shall be used and shall be understood to be generic to printing, writing, lining or any other marking of a continuous web whether the marking is visible or not. In the preferred process of this invention the topmost surface 20 of each individual web 10 of the plurality of continuous webs 10 is marked with a printing ink to provide the printed information and blanks usually found in a business form. However, it is sometimes the case that only one surface, normally the topmost surface 20, of the topmost continuous web 60 will be so marked. The actual content of the marking and the number of webs 10 which are marked are dependent on the particular form being manufactured and may be conveniently adjusted during the manufacturing operation.

In the preferred embodiment of this invention the marking step 13 is performed by the application of a marking fluid 21, preferably a printing ink, by suitable printing apparatus to one or more surfaces of the continuous webs 10. The preferred printing method is offset although any of the other well known printing methods are equally applicable. The actual printing method is merely an apparatus limitation and depends on the printer capabilities of the particular manufacturer. The inks which can be used in this printing step are any of the inks commonly used in the printing industry today. The ink must only be selected from a group or type which are compatible with the coating process and composition.

For the production of manifold carbonless forms according to the process of this invention it is necessary that at least one coating composition be applied to at least one surface of at least one continuous web 10. In the preferred embodiment of this invention each continuous web 10 of the plurality of continuous webs 10, except the topmost web 60, will have a CF coating 22 containing a color developer on the topmost surface and a CB coating 23 containing an encapsulated color precursor on the bottommost surface. As another preferred embodiment a self-contained image transfer system 24 can be used wherein both the color developer and color precursor are coated on a single surface, preferably the topmost surface 20, of each continuous web again with the exception of the topmost web 60 which does not require any coating material regardless of what particular form of carbonless transfer system is used.

Depending on the particular coating method and composition the coating of a self-contained composition 24 onto the continuous web 10 can require either one or two separate coating 14 steps. While the coating step 14 can be performed by a variety of known methods the preferred coating methods 14 and coating compositions are hot melt suspension media and radiation curable resins. One of the particularly significant advantages found in both of these preferred coating methods is that no coating drying step is necessary. Rather, a curing or setting step 30 is substituted for the drying step and no heat, elapsed time or elevated temperatures are necessary. Thus the coating compositions for use in the process of this invention are best described as solvent-free, nonaqueous coating compositions or expressed differently "100% solids coating".

HOT MELT SYSTEM

The preferred coating method 14 of this invention involves the use of a hot melt suspension medium, preferably waxes, resins or the like in combination with microcapsules, the microcapsules containing a color precursor or color precursor combination. The most preferred hot melt suspending media comprise the low molecular weight polar waxes. The hot melt suspending medium procedure described herein will be hereinafter sometimes referred to as the hot melt activation system. The hot melt activation system has been found most suitable for use as the CB coating 23 for carbonless paper although to a somewhat lesser extent it can also function as the CF coating 22 containing the color developer or color developer combination. This preferred procedure involves microencapsulating a color precursor using any of a variety of well-known microencapsulation techniques most of which require the use of a cross-linking agent with a wall forming compound to initiate an interfacial reaction resulting in the formation of microcapsules having characteristics determined by the particular wall forming compound.

The chromogenic coating composition for use in the hot melt embodiment of this invention is essentially a dispersion of a chromogenic material in a hot melt system. The chromogenic material can be either soluble or insoluble in the hot melt system and the color precursors are preferably in microencapsulated or dispersed form. Filler materials can also be added to the hot melt to modify the properties of the final coated substrate. The use of solvents, which require heat to remove them during the setting of the coated film, is avoided.

The chromogenic color precursors most useful in the practice of the hot melt embodiment of this invention are the electron-donors and include the lactone phthalides, such as crystal violet lactone, and 3,3-bis-(1'-ethyl-2-methylindol-3'-yl) phthalide, the lactone fluorans, such as 2-dibenzylamino-6-diethylaminofluoran and 6-diethylamino-1,3-dimethylfluorans, the lactone xanthenes, the leucoauramines, the 2-(omega substituted vinylene)-3,3-disubstituted-3-H indoles and 1,3,3-trialkylindolinospirans. Mixtures of these color precursors can be used if desired. In the preferred hot melt process of this invention microencapsulated oil solutions of color precursors are used. The color precursors are preferably present in such oil solutions in an amount of from about 0.5% to about 20.0% based on the weight of the oil solution, and the most preferred range is from about 2% to about 7%.

The hot melt suspending media generally useful in the practice of this invention include waxes and resins. The preferred group of compounds useful as hot melt suspending media include: deresinated, oxidized mineral waxes such as the montan waxes, amide waxes such as bis-stearamide wax, stearamide wax, behenamide wax, fatty acid waxes, hydroxylated fatty acid waxes, hydroxy stearate waxes, oxazoline waxes, amine waxes and mixtures thereof. The hot melt suspending medium is characterized by having a penetration hardness of less than or equal to from about 0.1 to about 20.0, a melting point of from about 60° C to about 140° C, a narrow melting range, a low viscosity when molten, a certain amount of polarity and a light color. Any wax or wax mixture with the foregoing properties can be used successfully as suspending media in the practice of this invention. These waxes are all suitable to act as a dispersing medium for the chromogenic material and other ingredients of the coating composition and at the same time are compatible with the chromogenic properties of the chromogenic material. These materials are settable to a solid when cooled.

Included in the preferred group of hot melt suspending media are the following waxes: 2-n-heptadecyl-4,4-bis-hydroxymethyl-2-oxazoline, N,N'-ethylenebis-stearamide, N-(2-hydroxyethyl)-12-hydroxystearamide, glyceryl monohydroxystearate and ethylene glycol monohydroxystearate.

Other waxes of this type which have generally proved to be effective are generically described as the modified mineral type, synthetic waxes or those of vegetable origin or combinations thereof. These waxes must be characterized by a high melting point and a great hardness which eliminates wax transfer to the developing sheet, thus improving image clarity, increasing blocking temperature and diminishing packing problems. One of the most preferred waxes for use in the process and product of this invention are the deresinated crude montan waxes. These waxes are produced from a raw material of bitumen-rich lignite which is extracted with organic solvents to corm a crude montan wax. The montan wax is deresinated by extraction with organic solvents followed by oxidation with chromic acid to yield acid waxes.

Another type of preferred hot melt suspending media is a non-polar hydrocarbon wax, such as Be Square 170/175 (m.p. range 170°–175° F) from Bareco Division of Petrolite Corporation which includes a small amount of dispersing agent. The dispersing agent may, for instance, by Turkey Red Oil.

The preferred waxes of this invention have a penetration hardness of from about 0.1 to about 20 measured by the needle penetration test given a ASTM designation of D1321-61T. The range of 0.1 to 20.0 represents a practical penetration hardness range. A more preferred range is from about 0.1 to about 3 and the most preferred range is from about 0.1 to about 1 on the same needle penetration index. The needle penetration index covers a test procedure for the empirical estimation of the consistency of waxes derived from petroleum by measurement of the extent of penetration of a standard needle. This method is applicable to waxes having the penetration of not greater than 250. The penetration of petroleum wax is the depth, in tenths of a millimeter, to which a standard needle penetrates into the particular wax under defined conditions. The defined conditions generally are that the sample is melted, heated to 30° F above its melting point, poured into a container, and then air cooled under controlled conditions. The sample is then conditioned at test temperature in a water bath. Penetration is measured with a penetrometer, which applies a standard needle to the sample for 5 seconds under a load of 100 grams.

A second characteristic of the desired hot melt suspending media of this invention is a melting point of from about 60° C to about 140° C. A more preferred melting point for the waxes or resins of this invention is from about 70° C to about 100° C. Also relative to the melting point, it is necessary for the coating composition of this invention to set rapidly after application to the particular substrate. More particularly, a practical melting range limitation, or in other words range of temperature in which the liquid hot melt composition sets into a solid composition, is from about 1.0° C to about 15° C. The preferred setting time is from about 0.5 second to about 5 seconds while the most preferred setting time is from about 0.5 seconds to about 2 seconds. While melting ranges of more than 15° C can be used the time necessary for such a coating composition to set requires special apparatus and handling and makes use of these hot melt compounds commercially unattractive.

The hot melt waxes and resins of this invention must also have a low viscosity when in a molten state in order to facilitate ease of spreading on the substrate. In general, it is desirable that the hot melt suspending media have a viscosity of less than about 120 centiposes at a temperature of approximately 5° above the melting point of a particular hot melt suspending medium. In addition, it is preferred that the hot melt wax or hot melt suspending media of this invention have a light color in order to be compatible with the final paper or plastic product being produced. This means that it is preferred for the hot melt to be white or transparent after application to the particular substrate being coated.

The preferred waxes, resins and other hot melt suspending media of this invention preferably are polar. By polar it is meant that a certain amount of polarity is characteristic of the preferred waxes, the polar compositions being characterized by the presence of functional groups selected from the group consisting of: carboxyl, carbonyl, hydroxyl, ester, amide, amine, heterocyclic groups and combinations thereof. An alternate but less preferred embodiment of this invention includes the use of non-polar hydrocarbon waxes which must be used in conjunction with a dispersing agent.

The additives which may be included in the hot melt CB coating composition are typically an opacifying agent such as titanium doxide or clay, a stilting agent such as Arrowroot starch and wax modifying agents such as polyvinyl acetate, isophthalic polyester, or any other resin materials soluble or dispersible in the main wax and which improves wax quality.

The method of dispersing the microcapsules in the hot melt suspending media is also important since it is, likewise, necessary to use a process which prevents significant agglomeration of the microcapsules. In the preferred process the microcapsules are formed into an aqueous slurry containing approximately 40% solids and are then spray dried to form a free-flowing powder. The free-flowing microcapsules are stirred into a molten phase of a suspension medium, such as a wax, a mixture of waxes, a resin or mixture thereof to form a smooth dispersion of microcapsules in the continuous molten phase. This hot melt can then be coated or printed, by gravure, blade coating, flexography or other means onto the continuous web 10. The hot melt system sets substantially immediately after application to the web and forms an excellent marking sheet.

In the most preferred embodiment of this invention a dispersing agent is added to the microcapsules prior to combining the microcapsules with the hot melt suspending medium. A preferred group of dispersing agents are the anionic dispersing agents, many of which are commercially available. A preferred group of anionic dispersing agents includes the sodium salts of condensed naphthalene sulfonic acids, the sodium salt of polymeric carboxylic acids, the free acids of complex organic phosphate ester, sulfated castor oil, poly-(methylvinyl ether/maleic and hydried) and combinations thereof. The most preferred dispersing agent is sulfated caster oil. The dispersing agent is added to the microcapsules in an amount of from about 0.1% to about 10% based on the dry weight of the microcapsules. A preferred range of addition is from about 0.5% to about 5.0% based on the dry weight of the microcapsules while a most preferred range is from about 1.0% to about 3.0% based on the dry weight of the microcapsules.

In the most preferred embodiment of this invention a dispersing agent is added to the microcapsules prior to combining the microcapsules with the hot melt suspending medium. In some instances the dispersing agent and the wall forming material are one in the same and the wall forming material not actually used in the microcapsule wall formation is present in hot melt coating dispersion as a dispersing agent. Although as described above many of the well-known, commercially available dispersing agents can be used in the process of product of this invention a group of secondary dispersing agents that may be present as excess wall forming material includes: hydroxypropylcellulose, gum arabic, gelatin, polyvinyl alcohol, carboxymethylcellulose and mixtures of the above.

While the dispersing agent can be added at any point in the process of this invention prior to the setting of the coating composition, to achieve the most desirable results the dispersing agent should be added to the microcapsules prior to combining the microcapsules with the hot melt suspending medium. The particular amount of dispersing agent used is dependent on several variables including the particular type of microcapsule used, the particular type of hot melt suspending medium, the concentration of the aqueous microcapsular slurry, the viscosity of the hot melt suspending medium and the desired final coated product. For purposes of this application a practical range of addition based on the weight of the microcapsules is from about 0.1 part by weight to about 10.0 parts by weight. A preferred range of addition would be from about 0.5 to about 5.0 parts by weight while the most preferred range of addition would be from about 1.0 to about 3.0 parts by weight.

The chromogenic coating composition can be applied to a substrate, such as paper or a plastic film by any of the common paper coating processes as developed above such as roll, blade coating or by any of the common printing processes, such as gravure, or flexographic printing. The rheological properties, particularly the viscosity of the coating composition, can be adjusted for each type of application by proper selection of the type and relative amounts of hot melt suspending media. While the actual amount of the hot melt coating dispersion applied to the substrate can vary depending on the particular final product desired, for purposes of coating paper substrates CB coat weight of from about 1 pound to about 8 pounds per 3300 square feet of substrate have been found practical. The preferred range of CB coat weight application is from about 2.5 pounds to about 5.0 pounds per 3300 square feet of substrate, while the most preferred range is from about 3 pounds to about 4 pounds per 3300 square feet of substrate. If the CB chromogenic materials and a color developer (CF) are combined into a single or self-contained chromogenic coating composition practical coat weights include from about 2.0 pounds to about 9.0 pounds per 3300 square feet of substrate, the preferred coat weight is from about 3.0 pounds to about 6.0 pounds per 3300 square feet, and the most preferred range is from about 4.0 pounds to about 5.0 pounds per 3300 square feet of substrate.

These hot melt coating dispersions or hot melt coating compositions, the terms being used interchangeably, can be set by any cooling means. Preferably a chill roll is used on the coating apparatus which cools the hot melt coating immediately after coating, but is also quite common to simply allow the coating composition to cool naturally by atmospheric exposure. As the temperature of the coating composition is substantially higher than room temperature and in light of the fact that the coating thickness is generally less than 50 microns it can be seen that when spread out over a substrate the hot melt material cools very rapidly. The actual exposure or chill time necessary for setting of the chromogenic coating composition is dependent on a number of variables, such as coat weight, the particular hot melt suspending medium used, type of cooling means, temperature of cooling means and others.

The choice of wall-forming material and hot melt suspending media is important since certain microcapsules having walls of hydroxyethylcellulose when made by certain patented process and certain polyamides tend to agglomerate even in polar waxes. Agglomeration is undesirable since this prevents uniform distribution of the chromogenic material on the CF sheet. This may adversely affect transfer and uniformity of the intensity of the formed image.

The particular method of encapsulation or the particular encapsuled chromogenic material are not asserted to be an inventive feature herein. Rather, there are described in the patent literature various capsular chromogenic materials which may be used. Such chromogens have been encapsulated in gelatin wall-forming materials (see U.S. Pat. No. 2,730,456 and 2,800,457) including gum arabic, in polyvinyl alcohol, in carboxymethylcellulose, in resorcinol-formaldehyde wall-formers (see U.S. Pat. No. 3,755,190), isocyanate wall-formers (see U.S. Pat. No. 3,914,511) and hydroxypropylcellulose (see application Ser. No. 480,956 filed June 19, 1975) in addition to mixtures of the above. Microencapsulation has been accomplished by a variety of known techniques including coacervation, interfacial polymerization, polymerization of one or more monomers in an oil, various melting, dispersing and cooling methods, and spray drying methods. Compounds which have been found preferable for use as wall forming compounds in the various microencapsulation techniques include: hydroxypropylcellulose, carboxymethylcellulose, gelatin, melamineformaldehyde, polyfunctional isocyanates and prepolymers thereof, polyfunctional acid chlorides, polyamines, polyols, epoxides and mixtures thereof.

Particularly well-suited to use in the present invention are microcapsules of a hydroxypropylcellulose (HPC) materials. This is because such microcapsules are easily dispersed in most hot melt media. If necessary, a small amount of dispersing agent as described above can also be added to improve the dispersion. In addition, the HPC capsules have good permeability, strength, and temperature characteristics.

RADIATION CURABLE SYSTEM

The second preferred coating method of this invention involves the use of radiation curable resins. As with the hot melt activation system the radiation curable resins can be used as either a CF 22 of a CB 23 coating but preferably are used as the CF 22 coating system. The basic concept of the radiation curable activation system involves dissolving a developing agent such as a novolak resin in a liquid radiation curable material which can be solidified by exposure to radiation such as ultraviolet or electron beam. The liquid mixture containing the developing agent and the liquid radiation curable material is then applied to a thin film to the continuous web 10 which is exposed to ultraviolet light to cure 30 the coating.

The radiation curable chromogenic coating composition useful in the process of this invention is essentially a dispersion of a chromogenic material in a liquid radiation curable substance. The chromogenic material can be either soluble or insoluble in the liquid radiation curable substance and the color developers are preferably in microencapsulated or dispersed form. Insoluble chromogenic color developers, for use in preparing carbonless record sheets such as the acid clays, are present in the coating composition as a dispersed particulate solid. Most organic color developers are soluble in the radiation curable substance of this invention.

The coating composition can contain additional materials which function as photoinitiators. Addition of these materials depends upon the particular method of curing the chromogenic coating. Filler materials can also be added to modify the properties of the cured film. The use of non-reactive solvents, which require heat to remove them during the drying or curing of the coated film, is avoided.

The chromogenic color developers most useful in the radiation curable embodiment of this invention are the acidic electron-acceptors and include acid clays such as attapulgus clay, and silton clay, phenolic materials such as 2-ethylhexylgallate, 3,5-di-tert-butyl salicylic acid, phenolic resins of the novolak type and metal modified phenolic materials such as the zinc salt of 3,5-di-tert-butyl salicylic acid and the zinc modified novolak type resins. The most preferred chromogenic color developers are the novolaks of p-phenylphenol, p-octylphenol and p-tert-butylphenol. Mixtures of these color developers may be used, if desired. They can be present in the liquid chromogenic composition in an amount of from about 25% to about 75% by weight of the chromogenic composition. The preferred range is from about 35% to about 65%, and the most preferred range is from about 40% to about 55%.

The radiation curable substances useful in the practice of this invention comprises the free radical polymerizable ethylenically unsaturated organic compounds. These compounds must contain at least one terminal ethylenic group per molecule. They are liquid and act as dispersing media for the chromogenic material and other ingredients of the coating composition. They are curable to a solid resin when exposed to ionizing or ultraviolet radiation. Curing is by polymerization.

A preferred group of radiation curable compounds are the polyfunctional ethylenically unsaturated organic compounds which have more than one (two or more) terminal ethylenic groups per molecule. Due to the polyfunctional nature of these compounds, they cure under the influence of radiation by polymerization, including crosslinking, to form a hard dry tack-free film.

Included in the preferred group of radiation curable compounds are the polyesters of ethylenically unsaturated acids such as acrylic acid and methacrylic acids, and a polyhydric alcohol. Examples of some of these polyfunctional compounds are the polyacrylates or methacrylates of trimethylolpropane, pentaerythritol, dipentaerythritol, ethylene glycol, triethylene glycol, propyleneglycol, glycerin, sorbitol, enopentylglycol and 1,6-hexanediol, hydroxy-terminated polyesters, hydroxy-terminated epoxy resins, and hydroxy-terminated polyurethanes and polyphenols such as bisphenol A. An example of a polyacrylate of a hydroxy-terminated polyurethane found to be useful in this invention is di(2'-acryloxyethyl)-4-methylphenylenediurethane.

Also included in this group are polyallyl and polyvinyl-compounds such as diallyl phthalate and tetrallyloxyethane, and divinyl adipate, butane divinyl ether and divinylbenzene. Mixtures of these polyfunctional compounds and their oligomers and prepolymers may be used if desired.

A second group of radiation curable compounds are the monofunctional ethylenically unsaturated organic compounds which have one terminal ethylenic group per molecule. Examples of such monofunctional compounds are the $C_8$ and $C_{16}$ alcohol esters of acrylic and methacrylic acid, and styrene, substituted styrenes, vinyl acetate, vinyl ethers and allyl ethers and esters. In general, these compounds are liquid and have a lower viscosity than the polyfunctional compounds and thus may be used to reduce the viscosity of the coating composition to facilitate coating by any desired method. These compounds are radiation curable and react with the ethylenically unsaturated polyfunctional organic compounds during radiation curing to give a hard drying flexible film. Compounds having only one terminal ethylenic group may be used alone as the radiation curable substance. However, the resultant radiation cured film may be rather soft and pliable and may be somewhat too tacky for commercial use. The preferred radiation curable substance is a mixture containing one or more polyfunctional compounds and one or more monofunctional compounds. By proper selection of these compounds a chromogenic coating composition having the desired coating characteristics for any type of coating application can be made, and a hard, flexible tack-free radiation cured film can be obtained. In general, the most desired films are obtained by using a radiation curable substance comprising from about 33% to about 67% of the polyfunctional compounds to about 33% to about 67% of the monofunctional compounds.

A photoinitiator is preferably added to the coating compositions if the composition is to be cured by ultraviolet radiation. A wide variety of photoinitiators are available which serve well in the system described in this invention. The preferred photoinitiators are the benzoin alkyl ethers, such as, Vicure 30 (a mixture of alkylbenzoin ethers manufactured and sold by Stauffer Chemical Co., Westport, Connecticut), benzoin butyl ether (Vicure 10, Stauffer), benzoin methyl ether, and $\alpha,\alpha$-diethoxyacetophenone. Other photoinitiators which have been used are benzophenone,4,4'-bis(dimethylamino)benzophenone, ferrocene, xanthone, thioxanthane, $\alpha,\alpha$-azobisisobutylnitrile, decabromodiphenyl oxide, pentabromomonchlorocyclohexane, pentachlorobenzene, polychlorinated biphenyls such as the Arochlor 1200 series (manufactured and sold by Monsanto Chemical Co., St. Louis, Missouri), benzoin ethyl ether, 2-ethylanthroquinone,1-(chloroethyl)naphthalene, desyl chloride, chlorendic anhydride, naphthalene sulfonyl chloride and 2-bromoethyl ethyl ether. Zinc oxide combined with a small quantity of water also serves as a good substitute photoinitiation system. The amount of photoinitiator added can be from about 0.2% to about 10% by weight of the coating composition, with a preferred range being from about 3% to about 8% by weight.

Photoinitiation synergists can also be added to the ultraviolet curing coating compositions. Photoinitiation synergists serve to enhance the initiation efficiency of the photoinitiators. The preferred synergists are chain transfer agents, such as the tertiary alcoholamines and substituted morpholines, such as triethanolamine, N-methyldiethanolamine, N,N-dimethylethanolamine and N-methylmorpholine. The amount of photoinitiation synergist added can be from about 0.2% to about 10% by weight of the coating composition, with a preferred range being from about 3% to about 8% by weight.

Filler materials can be added as flattening agents, particularly to color developing coating compositions, to reduce the glossy appearance of the cured resin films and preserve the appearance of the substrate prior to coating. Thus a bond paper which has been coated with the coating composition of this invention and which is then cured to a solid film gives the impression of being an uncoated bond paper.

The preferred filler materials are of the colloidally precipitated or fumed silicas. Typical of the silicas which can be used are the ones tradenamed LoVel 27 (a precipitated silica manufactured and sold by PPG Industries, Inc., Pittsburgh, Pennsylvania), Syloid 72 (a hydrogel silica manufactured and sold by W. R. Grace & Co., Davison Chemical Division, Baltimore, Maryland) and Cab-o-sil (a fumed silica manufactured and sold by Cabot Corporation, Boston, Massachusetts). All of these silicas are known to give an initial bluish color with color precursors such as crystal violet lactone. However, this color fades quickly on aging. Using the record sheet produced by the process of this invention, the developed color does not fade easily. It is theorized that the filler material through its large surface area provides for increased porosity of the cured resin film, thereby promoting more rapid and more complete transfer of an oily solution of color precursors from a transfer sheet to the record sheet surface. The amount of filler materials can be up to about 15% by weight of the coating composition and the preferred range is from about 10% to about 15% by weight.

Mixing of the ingredients of the coating composition is not critical. Ingredients can be added one at a time or they can be added all at once and stirred until they are uniformly mixed. Good results are obtained when the ingredients making up the radiation curable substance and the chromogenic material are heated with stirring to facilitate blending of these ingredients. If used, the photoinitiator, photoinitiation synergist and filler are best added when the coating composition is at or slightly above room temperature. It is also preferable to add microcapsules at room temperature.

The chromogenic coating compositions can be applied to a substrate, such as paper or a plastic film by any of the common paper coating processes such as roll, air knife, or blade coating, or by any of the common printing processes, such as offset, gravure, or flexographic printing. The rheological properties, particularly the viscosity, of the coating composition, can be adjusted for each type of application by proper selection of the type and relative amounts of liquid radiation curable compounds. While the actual amount of chromogenic coating composition applied to the substrate can vary depending on the particular final product desired, for purposes of coating paper substrates the practical range of coat weights for the CF chromogenic coating compositions of this invention are from about 0.2 pounds to about 8 pounds per 3300 square feet of substrate, the preferred range being from about 0.5 pounds to about 4 pounds per 3300 square feet of substrate and the most preferred range from about 1.0 pounds to about 3.0 pounds per 3300 square feet of substrate. If the CF and CB chromogenic materials are combined into a single or self-contained chromogenic coating compositions practical coat weights include from about 2.0 to about 9.0 pounds per 3300 square feet of substrate, the preferred coat weight is from about 3.0 pounds to about 6.0 pounds per 3300 square feet, and the most preferred range is from about 4.0 pounds to about 5.0 pounds per 3300 square feet of substrate.

These coating compositions can be cured by any free radical initiated chain propagated addition polymerization reaction of the terminal ethylenic groups of the radiation curable compounds. These free radicals can be produced by several difference chemical processes including the thermal or ultraviolet induced degradation of a molecular species and any form of ionizing radiation utilizing alpha-particles, beta-rays (high-energy electrons), gamma-rays, x-rays and neutrons. The actual exposure time necessary for curing of the chromogenic coating composition is dependent on a number of variables such as coat weight, coat thickness, the particular radiation curable substance, type of radiation, source of radiation, radiation intensity and distance between the radiation source and the coated substrate. In most instances curing is virtually instantaneous with actual curing times ranging from about 1 millisecond to about 2.0 seconds. The preferred curing time is from about 0.1 seconds to about 1.0 seconds, while the most preferred curing time is from about 0.3 seconds to about 0.6 seconds.

The preferred curing process is by exposure of the coating composition to ultraviolet radiation having a wavelength of about 2000° A to about 4000° A. For ultraviolet curing to occur the composition must contain suitable ultraviolet absorbing photoinitiators which will produce polymerization initiating free radicals upon exposure to the radiation source. A typical ultraviolet source suitable for this type of curing process is a Hanovia 200 watt medium pressure mercury lamp. Curing efficiencies of the coating composition are dependent on such parameters as the nature of the radiation curable substance, atmosphere in contact with the coating, quantum efficiency of the radiation absorbed, thickness of coating and inhibitory effects of the various materials in the composition.

In the ionizing radiation induced curing of these coating compositions a specific radiation absorbing material (photoinitiator) is not necessary. Exposure of the coating composition to a source of high energy electrons results in the spontaneous curing of the composition to a hard, tack-free coating. Any of a number of commercially available high energy electron beam or linear cathode type high energy electron sources are suitable for curing these compositions. Parameters such as the atmospheric environment and inhibitory effects of the various materials in the composition play an important role in the determination of the curing efficiency of these compositions.

A particular advantage of the coating step 14 of the process of this invention is that it permits the use of spot coating. Spot coating refers to the fact that less than 100% of the surface area of the individual sheet whether it is a CF, CB, self-contained or other sheet need be coated. For instance, the area of the paper normally associated with the margin on either side of the printed side portion need not be coated as illustrated in FIGS. 2 through 6 and identified by the number 40. This, of course, represents a significant cost advantage in the savings of encapsulated material. The encapsulated material is one of the most costly material which goes into the forms manufacture. Therefore by eliminating certain sections of the web surface 40 that need to be coated 14 a significant cost savings can be appreciated. The use of spot printing can vary from simply omitting coating of the margin portion of the paper 40 to the making of a form wherein only a single line is actually coated. At the same time, forms such as computer printouts can be made wherein only every other line is coated. Thus it can be seen that from about 10% to about 95% of the surface area of the paper need not be coated. In most instances it would be most convenient to simply not print the marginal areas of the paper 40 which would save from about 10% to about 30% of the total encapsulated material cost.

After the coating or coatings have been applied to one, several or all of the continuous substrates 10 they are advanced to adhesion means 45 illustrated in FIG. 1 by paired rollers 45. An adhesive is applied to one or more edges of the plurality of continuous webs 10 or in the alternative an adhesive can be applied over all or a portion of the surface of one or more of the continuous webs. Any of the well known glues or adhesives normally used in the paper industry are usable in the adhesion means 45 of this invention. Alternate adhesion methods include bonding members such as adhesive strips, staples, V-shaped slits and other less commonly encountered methods. While the adhesion step 45 has been described and shown in FIG. 1 as occurring after the coating step or steps and before the collating 50 and finishing 12 steps it can be completed at any convenient point during the process of this invention. More particularly, in the most preferred embodiment of the process of this invention a liquid adhesive is applied by adhesion means 45 prior to the collating 50 step and the individual webs 10 are combined during the finishing 12 step. Thus in the most preferred embodiment an adhesive is applied prior to collating 50 but the webs 10 themselves are not actually placed in combination with one another until the finishing step 12. In another embodiment of this invention the adhesion means 45 may be omitted altogether and the individual webs 20 are not necessarily joined to one another but may be merely arranged in the appropriate sequence with one another. In still another embodiment of this invention the adhesion means 45 may be located after the collating 50 means in the operating sequence. In a further embodiment the collated and finished sheets may be bound or adhered to one another after the finishing step 12. The particular sequence and apparatus used in the adhesion means 45, collating means 50 and finishing means 12 is a matter of individual choice and is dependent upon the final product desired. No special significance is attached to the particular order or occurrence of these steps.

After the adhesive operation 45 the continuous substrates 10 are advanced to collating means 50. The collating means 50 arrange the various individual continuous webs 10 into the proper relationship with one another. This can involve the arrangement of colors if the customer copy or if the original is white the customer copy is green and the file copy is red or in the alternative this can involve the arrangement of particular sheets so that the CB 23 and CF 22 coated sheets will be in content when the final form is made. If self-contained type carbonless paper is used the coated 24 surface of the paper is the topmost surface 20 of each sheet. All of this is done by prearranged programming of the collating apparatus 50.

After collating the forms are finished 12 by any of a variety of steps. The finishing operation can involve the steps of attaching the sheets to one another, partitioning the sheets into suitable sizes, stacking the sheets into appropriate stacks and/or packaging the sheets. All of the operations from the beginning of the use of a plurality of continuous webs 10 to the final packaging operation 12 are accomplished as a single on-line operation.

While the invention has been illustrated and described in detail in the drawing and foregoing description, the same is to be considered illustrative and not restrictive in character it being understood that only the preferred embodiment has been shown and described and that all changes and modifications that come within the spirit of the invention and the scope of the claims are also desired to be protected.

We claim:

1. A process for the continuous production of a manifold carbonless form having two or more surfaces coated with chromogenic material comprising:

(a) providing a plurality of continuous webs; each of said continuous webs having a first and second surface;

(b) advancing each web of said plurality of continuous webs at substantially the same speed, said plurality of continuous webs being spaced apart and being advanced in a cooperating relationship with one another;

(c) marking at least one surface of at least one web of said plurality of continuous webs with a pattern;

(d) applying a first non-aqueous, solvent-free coating of a first chromogenic material to at least a portion of said first surface of at least one web of said plurality of continuous webs, said first non-aqueous, solvent-free coating comprising said first chromogenic material dispersed in a hot melt suspending medium, said coating being heated to a temperature above the melting point of said hot melt suspending medium to permit fluid application of said first coating composition to said first surface;

(e) setting said first coating by means of temperature decrease;

(f) applying a second coating of a second chromogenic material to at least a portion of said second surface of at least one web of said plurality of continuous webs, said second coating comprising said second chromogenic material dispersed in a hot melt suspending media, said second coating being heated to a temperature above the melting point of said hot melt suspending media to permit fluid application of said second coating composition to said second surface, said second chromogenic material being reactive with said first chromogenic material to form a color;

(g) setting said second coating by means of temperature decrease;

(h) collating said plurality of continuous webs such that said first and said second chromogenic materials are in facing relationship to a coreactive chromogenic material; and (i) placing said collated continuous webs in contiguous relationship to one another to create a manifold form.

2. The process of claim 1 further comprising the step of finishing said collated, contiguous webs wherein said finishing step includes:

(a) fixably combining said plurality of collated, contiguous webs into a single manifold substrate;

(b) dividing said single manifold substrate into a plurality of sheets, each sheet of said plurality of sheets being dimensioned for use as a manifold carbonless form;

(c) stacking said sheets; and (d) packaging said stacked sheets.

3. The process of claim 1 wherein said continuous webs are paper.

4. The process of claim 1 wherein said plurality of continuous webs comprise from about 2 to about 6 continuous webs.

5. The process of claim 1 wherein said marking is by means of printing.

6. The process of claim 1 wherein said marking is by offset printing means.

7. The process of claim 1 wherein said application of said first non-aqueous, solvent-free coating is by means of printing.

8. The process of claim 1 wherein said hot melt suspending media comprises a low molecular weight polar wax.

9. The process of claim 1 wherein said first coating composition is applied to from about 30% to about 70% of the surface area of at least one continuous web of said plurality of continuous webs.

10. A process for the continuous production of a manifold carbonless form having two or more surfaces coated with chromogenic material comprising:

(a) providing a plurality of continuous webs; each of said continuous webs having a first and second surface;

(b) advancing each web of said plurality of continuous webs at substantially the same speed, said plurality of continuous webs being spaced apart and being advanced in a cooperating relationship with one another;

(c) marking at least one surface of at least one web of said plurality of continuous webs with a pattern;

(d) applying a first non-aqueous, solvent-free coating of a first chromogenic material to at least a portion of said first surface of at least one web of said plurality of continuous webs, said first non-aqueous, solvent-free coating comprising said first chromogenic material dispersed in a hot melt suspending medium, said coating being heated to a temperature above the melting point of said hot melt suspending medium to permit fluid application of said first coating composition to said first surface;

(e) setting said first coating by means of temperature decrease;

(f) applying a second coating of a second chromogenic material to at least a portion of said second surface of at least one web of said plurality of continuous webs, said second coating comprising said second chromogenic material dispersed in a radiation curable material, said second coating being applied to said second surface in fluid form, said second chromogenic material being reactive with said first chromogenic material to form a color;

(g) setting said second coating by means of exposure to radiation;

(h) collating said plurality of continuous webs such that said first and said second chromogenic materials are in facing relationship to a coreactive chromogenic material; and (i) placing said collated continuous webs in contiguous relationship to one another to create a manifold form.

11. The process of claim 10 wherein said radiation curable material comprises a mixture of ethylenically unsaturated organic compounds, a portion of said compounds having one terminal ethylenic group per molecule and another portion of said compound having more than one terminal ethylenic group per molecule.

12. The process of claim 10 wherein said radiation is ultraviolet radiation.

13. The process of claim 10 wherein said radiation is electron beam radiation.

14. A process for the continuous production of a manifold carbonless form having two or more surfaces coated with chromogenic material comprising:

(a) providing a plurality of continuous paper substrates, each of said continuous paper substrates having a first and second surface, said plurality of continuous paper substrates including from about 2 to about 6 continuous paper substrates;

(b) advancing each substrate of said plurality of continuous substrates at substantially the same speed, said plurality of continuous substrates being spaced apart and being advanced in a cooperating relationship with one another;

(c) applying a printing ink to said second surface of at least one continuous paper substrate of said plurality of continuous paper substrates, said printing ink being applied in a pattern corresponding to a printed image;

(d) applying a first non-aqueous, solvent-free coating of a first chromogenic material to at least a portion of said first surface of at least one web of said plurality of continuous webs, said first non-aqueous, solvent-free coating comprising said first chromogenic material in capsular form dispersed in a hot melt suspending medium, said first coating being heated to a temperature above the melting point of said hot melt suspending medium to permit fluid application of said first coating composition to said first surface;

(e) setting said first coating by means of temperature decrease;

(f) applying a second non-aqueous, solvent-free coating of a second chromogenic material to at least a portion of said second surface of at least one web of said plurality of continuous webs, said second non-aqueous, solvent-free coating comprising said second chromogenic material dispersed in a hot melt suspending medium, said second coating being heated to a temperature above the melting point of said hot melt suspending medium to permit fluid application of said second coating composition to said second surface, said second chromogenic material being reactive with said first chromogenic material to form a color;

(g) setting said second coating by means of temperature decrease;

(h) collating said plurality of continuous webs such that said first and said second chromogenic materials are in facing relationship to a coreactive chromogenic material;

(i) placing said collated continuous webs in contiguous relationship to one another to create a manifold form;

(j) finishing said manifold form, said finishing including the steps of:

(1) fixably combining said plurality of collated contiguous paper substrates into a single manifold substrate;

(2) dividing said single manifold substrate into a plurality of sheets, each sheet of said plurality of sheets being dimensioned for use as a manifold carbonless form;

(3) stacking said sheets; and (4) packaging said stacked sheets.

15. A process for the continuous production of a manifold carbonless form having two or more surfaces coated with chromogenic material comprising:

(a) providing a plurality of continuous paper substrates, each of said continuous paper substrates having a first and second surface, said plurality of continuous paper substrates including from about 2 to about 6 continuous paper substrates;

(b) advancing each web of said plurality of continuous webs at substantially the same speed, said plurality of continuous webs being spaced apart and being advanced in a cooperating relationship with one another;

(c) applying a printing ink to said second surface of at least one continuous paper substrate of said plurality of continuous paper substrates, said printing ink being applied in a pattern corresponding to a printed image;

(d) applying a first non-aqueous, solvent-free coating of a first chromogenic material to at least a portion of said second surface of at least one web of said plurality of continuous webs, said first non-aqueous, solvent-free coating comprising said first chromogenic material in capsular form dispersed in a hot melt suspending medium, said first coating being heated to a temperature above the melting point of said hot melt suspending medium to permit fluid application of said first coating composition to said second surface;

(e) setting said first coating by means of temperature decrease;

(f) applying a second non-aqueous, solvent-free coating of a second chromogenic material to at least a portion of said second surface of at least one web of said plurality of continuous webs, said second non-aqueous, solvent-free coating comprising said second chromogenic material dispersed in a radiation curable material, said second coating being applied to said second surface in fluid form, said second chromogenic material being reactive with said first chromogenic material to form a color;

(g) setting said second non-aqueous, solvent-free coating by means of exposure to radiation;

(h) collating said plurality of continuous webs such that said first and said second chromogenic materials are in facing relationship to a coreactive chromogenic material;

(i) placing said collated continuous webs in contiguous relationship to one another to create a manifold form;

(j) finishing said manifold form, said finishing including the steps of:

(1) fixably combining said plurality of collated contiguous paper substrates into a single manifold substrate;

(2) dividing said single manifold substrate into a plurality of sheets, each sheet of said plurality of sheets being dimensioned for use as a manifold carbonless form;

(3) stacking said sheets; and (4) packaging said stacked sheets.

16. A process for the continuous production of a manifold carbonless form having two or more surfaces coated with chromogenic material comprising:

(a) providing a plurality of continuous paper substrates, each of said continuous paper substrates having a first and second surface, said plurality of continuous paper substrates including from about 2 to about 6 continuous paper substrates;

(b) advancing each substrate of said plurality of continuous substrate at substantially the same speed, said plurality of continuous substrates being spaced apart and being advanced in a cooperating relationship with one another;

(c) applying a printing ink to said second surface of at least one continuous paper substrate of said plurality of continuous paper substrates, said printing ink being applied in a pattern corresponding to a printed image;

(d) applying a first non-aqueous, solvent-free coating of a first chromogenic material to at least a portion of said first surface of at least one web of said plurality of continuous webs, said first non-aqueous, solvent-free coating comprising said first chromogenic material in capsular form dispersed in a radiation curable material, said first coating being applied to said first surface in fluid form;

(e) setting said first coating by means of exposure to radiation;

(f) applying a second non-aqueous, solvent-free coating of a second chromogenic material to at least a portion of said second surface of at least one web of said plurality of continuous webs, said second non-aqueous, solvent-free coating comprising said second chromogenic material dispersed in a radiation curable material, said second coating being applied to said second surface in fluid form, said second chromogenic material being reactive with said first chromogenic material to form a color;

(g) setting said second coating by means of exposure to radiation;

(h) collating said plurality of continuous webs such that said first and said second chromogenic materials are in facing relationship to a coreactive chromogenic material;

(i) placing said collated continuous webs in contiguous relationship to one another to create a manifold form;

(j) finishing said manifold form, said finishing including the steps of:

(1) fixably combining said plurality of collated contiguous paper substrates into a single manifold substrate;

(2) dividing said single manifold substrate into a plurality of sheets, each sheet of said plurality of sheets being dimensional for use as a manifold carbonless form;

(3) stacking said sheets; and (4) packaging said stacked sheets.

17. The process of claim 10 wherein said first coating composition is applied to from about 30% to about 70% of the surface area of at least one continuous web of said plurality of continuous webs.

* * * * *